US011686052B2

(12) United States Patent
Nicholls

(10) Patent No.: US 11,686,052 B2
(45) Date of Patent: Jun. 27, 2023

(54) SYNTHETIC TURF WITH INTEGRATED IMPACT SENSORS

(71) Applicant: Turf Alliance LLC, Welland (CA)

(72) Inventor: Mark H. Nicholls, Welland (CA)

( * ) Notice: Subject to any disclaimer, the term of this patent is extended or adjusted under 35 U.S.C. 154(b) by 273 days.

(21) Appl. No.: 16/548,765

(22) Filed: Aug. 22, 2019

(65) Prior Publication Data

US 2020/0063380 A1 Feb. 27, 2020

Related U.S. Application Data

(60) Provisional application No. 62/721,382, filed on Aug. 22, 2018.

(51) Int. Cl.
*E01C 13/08* (2006.01)

(52) U.S. Cl.
CPC ..... *E01C 13/083* (2013.01); *A63B 2220/12* (2013.01); *A63B 2220/53* (2013.01); *A63B 2220/836* (2013.01)

(58) Field of Classification Search
CPC . E01C 13/083; E01C 13/02; A63B 2220/836; A63B 2220/53; A63B 2220/12; A63B 2220/833; A63B 2220/80
See application file for complete search history.

(56) References Cited

U.S. PATENT DOCUMENTS 6,515,586 B1 * 2/2003 Wymore ..... G08B 13/10 340/541
2011/0260890 A1 * 10/2011 Larsen ..... A63B 69/3667 341/20
2013/0243367 A1 * 9/2013 Belisle ..... G01P 13/00 385/12
2017/0116445 A1 * 4/2017 Debates ..... G06K 19/07345
2017/0175343 A1 * 6/2017 des Garennes ..... E01C 13/08

FOREIGN PATENT DOCUMENTS

WO WO-2005026441 A2 * 3/2005 ..... E01C 13/08

OTHER PUBLICATIONS

Wu et al. "Integrated Ground Reaction Force Sensing and Terrain Classification for Small Legged Robots", Jul. 2016, IEEE Robotics and Automation Letters, vol. 1, No. 2, pp. 1125-1132 (Year: 2016).*

* cited by examiner

*Primary Examiner* — Mohamed Charioui
(74) *Attorney, Agent, or Firm* — Harter Secrest & Emery LLP

(57) ABSTRACT

Presented is an apparatus and system for an artificial turf system. The artificial turf system includes a backing layer having a plurality of fibers extending therefrom. The artificial turf system further includes a plurality of impact sensors located at least partially on, in, and/or beneath the backing layer, wherein the plurality of impact sensors are operable to detect a force or pressure applied to the backing layer.

4 Claims, 8 Drawing Sheets

SYNTHETIC TURF WITH INTEGRATED IMPACT SENSORS

TECHNICAL FIELD

The present subject matter relates generally to synthetic turf, and more particularly to synthetic turf having a plurality of sensors for detecting impacts and/or pressure thereon during an athletic event.

BACKGROUND

Artificial turf fields, pitches, and courts may be utilized in place of natural grass surfaces. An artificial turf field may comprise rows of synthetic ribbons that extend generally vertically from a backing layer. The synthetic ribbons may be designed to resemble grass.

Many athletic leagues, associations, and clubs are focused on improving player safety and reducing the risk of serious injury. Improving safety may involve rule changes, equipment innovation/modification, and injury-prevention research. To increase the amount of data available for injury-prevention analysis, it would be beneficial to provide an athletic field with integrated sensors. Integrated sensors may also be utilized to indicate not only the point and force of impact of athletes upon an athletic field, but also the impact point of a ball upon an athletic field in sports such as, but not limited to, field sports, tennis and golf. The present subject matter discloses an artificial turf system having integrated sensors to collect information concerning impacts thereon.

SUMMARY

The present disclosure provides for an artificial turf system with integrated impact sensors. In an exemplary embodiment, an artificial turf system (10) includes a backing layer (34) having a plurality of fibers (32) extending therefrom, and a plurality of impact sensors (38) located at least partially beneath the backing layer, wherein the plurality of impact sensors are operable to detect a force or pressure applied to the backing layer.

In an exemplary embodiment, an artificial turf system (10) includes a backing layer (34) having a plurality of upstanding ribbons (32) extending therefrom and having an infill layer (36) interspersed between the upstanding ribbons extending from the backing layer, and a plurality of impact sensors (38) located at least partially above the backing layer, wherein the plurality of impact sensors are operable to detect an impact of an athlete or ball.

In an exemplary embodiment, an artificial turf system (10) includes a backing layer (34) having a plurality of fibers (32) extending therefrom, a plurality of impact sensors (38) located at least partially beneath the backing layer, wherein the plurality of impact sensors are operable to detect a force or pressure applied to the backing layer by one or more athletes, and a plurality of position sensors (60) coupled with the one or more athletes operable to determine a position of the one or more athletes relative to one or more of the plurality of impact sensors at a discrete interval of time.

BRIEF DESCRIPTION OF THE DRAWINGS

The accompanying drawings are incorporated herein as part of the specification. The drawings described herein show embodiments of the present disclosure and are illustrative of selected principles and teachings of the presently disclosed subject matter. However, the drawings do not illustrate all possible implementations of the presently disclosed subject matter and are not intended to limit the scope of the present disclosure in any way.

DESCRIPTION OF THE EMBODIMENTS

Figure 1:
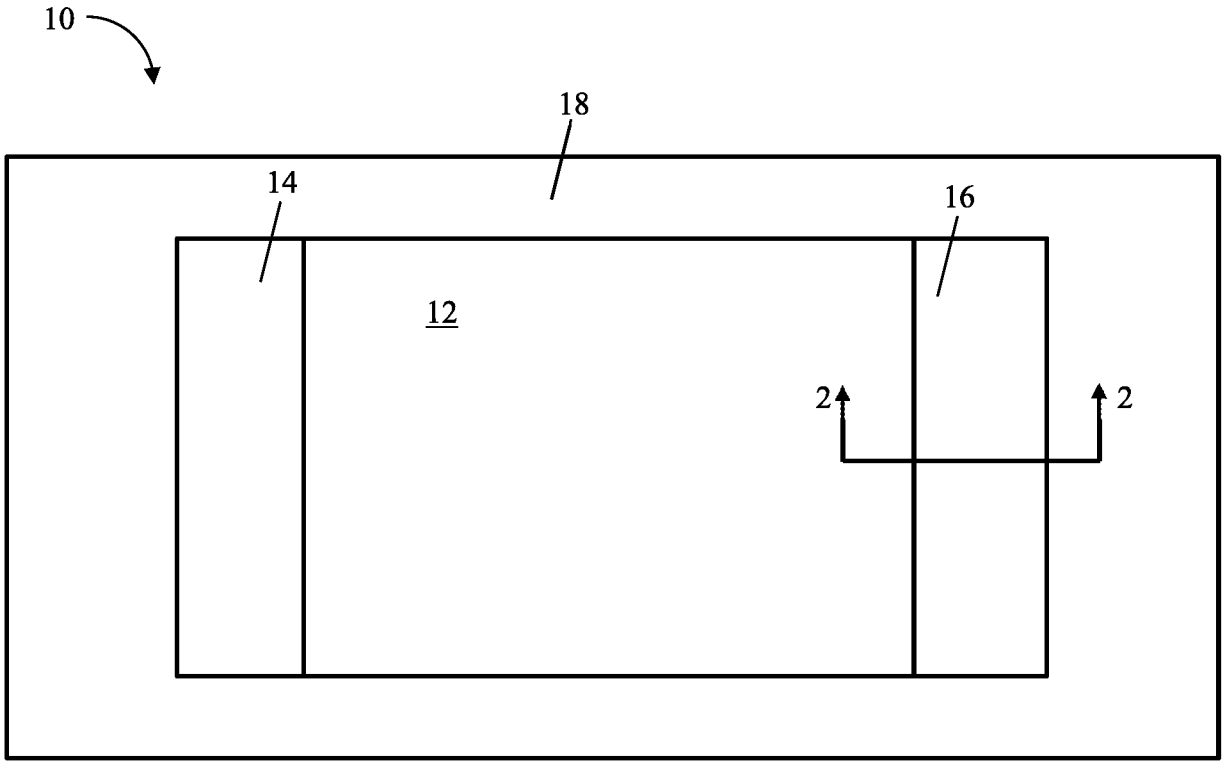
FIG. 1 is a plan view of an athletic field utilizing an artificial turf system according to an embodiment of the presently disclosed subject matter.

It is to be understood that like reference numerals are intended to identify the same structural elements, portions or surfaces consistently throughout the several drawing figures, as such elements, portions or surfaces may be further described or explained by the entire written specification, of which this detailed description is an integral part. It is also to be understood that the specific devices, assemblies, systems and processes illustrated in the attached drawings, and described in the following specification are simply exemplary embodiments of the inventive concepts defined herein. Unless otherwise indicated, the drawings are intended to be read (e.g., cross-hatching, arrangement of parts, proportion, debris, etc.) together with the specification, and are to be considered a portion of the entire written description of the invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or of rotation, as appropriate.

Additionally, it is to be understood that the invention may assume various alternative orientations and step sequences, except where expressly specified to the contrary. Hence, specific dimensions, directions or other physical characteristics relating to the embodiments disclosed are not to be considered as limiting, unless expressly stated otherwise.

Referring now to FIG. 1, in an embodiment, a multipurpose artificial turf system 10 is installed to create an American football field. The artificial turf system 10 may be utilized to create a field of play 12, a first end zone 14, a second end zone 16, and a surrounding field 18. It will be evident to a person skilled in the relevant arts that other configurations of the artificial turf system 10 are possible. For example without limitation, the artificial turf system 10 may be utilized to create a soccer field/football pitch, a baseball field, a rugby field, a golf range, a putting green, or other recreation area.

Figure 2:
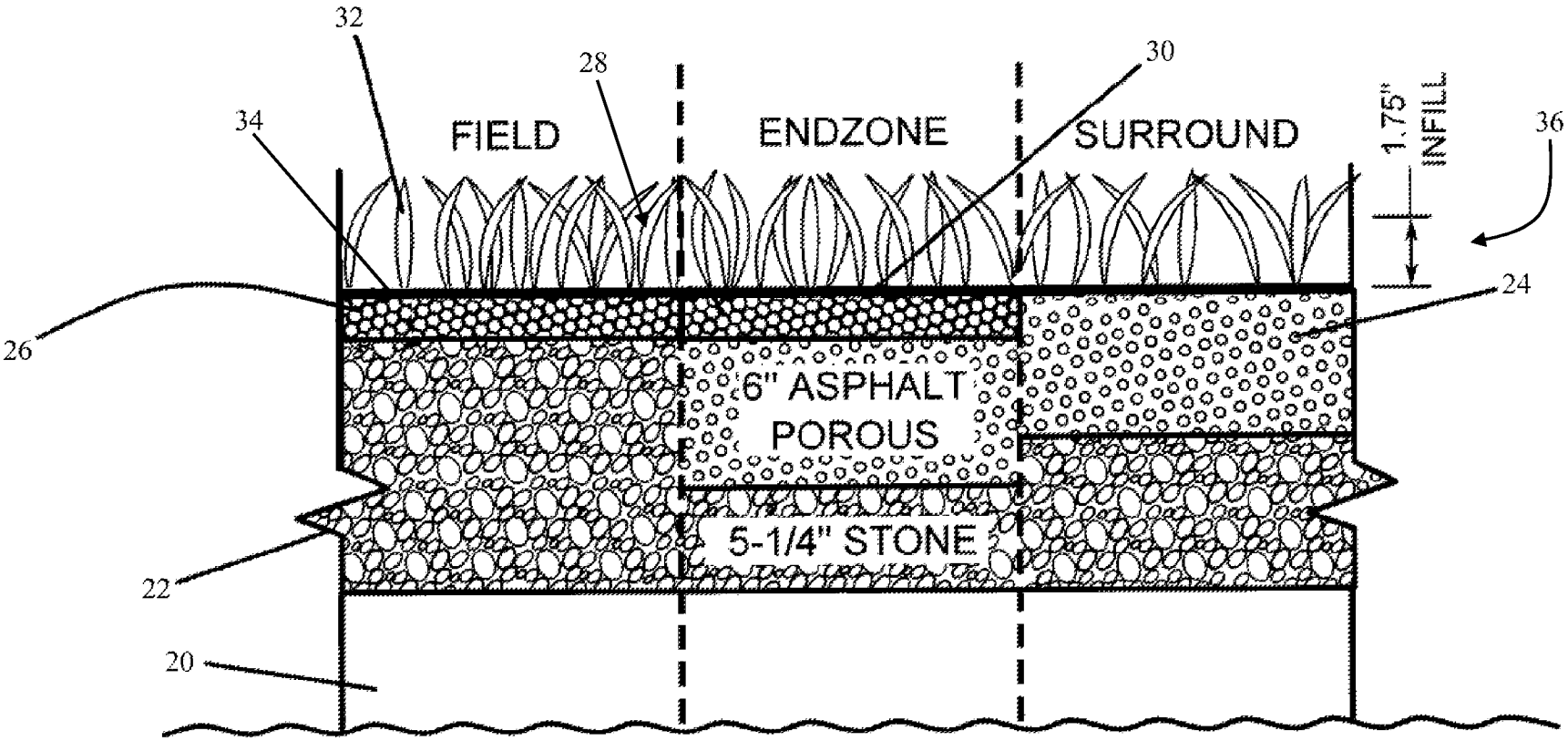
FIG. 2 is a cross-sectional view taken along lines 2-2 of FIG. 1.

As illustrated in FIG. 2, in an embodiment, the artificial turf system 10 includes several layers. In this embodiment, the artificial turf system 10 may be installed on a base layer comprising a concrete slab 20. A first intermediate layer 22 may be provided on top of the concrete slab 20. The first intermediate layer 22 may comprise, but is not limited to, stones or asphalt. A second intermediate layer 24 of porous asphalt may be disposed on top of the first intermediate layer 22. The second intermediate layer 24 may be referred to herein as the "porous asphalt layer." A resilient layer 26 may be provided on top of the first and second intermediate layers 22, 24 respectively. The resilient layer 26 may comprise an elastomeric material and may be referred to as the "elastomeric layer" herein.

The additional layers provided upon the concrete slab 20 provide for drainage and cushioning beneath a surface 28 of the artificial turf system 10. While a multi-layer support system 22, 24, 26 is shown and described, different types of layers and/or more/fewer layers may be used as alternatives. For example and without limitation, the base layer 20 may comprise either porous or non-porous asphalt with a top cushioning elastomeric layer or may comprise a single layer only.

As illustrated in FIG. 2, the artificial turf system 10 may comprise a top layer 30. The top layer 30 may comprise a backing layer 34 having artificial/synthetic fibers 32 disposed therethrough and extending from a surface thereof. In an embodiment, the artificial/synthetic fibers 32 may be synthetic ribbons. The backing layer 34 may be disposed directly onto the elastomeric layer 26. The backing layer 34 may be permanently or removably attached to the elastomeric layer 26.

The artificial turf system top layer 30 includes the primary backing layer 34 and the plurality of upstanding artificial/synthetic fibers 32, extending upwardly from the upper surface of backing layer 34. In an embodiment, the artificial/synthetic fibers 32 may be fibrillated or slit-film extruded polyethylene ribbons representing blades of grass. Fibrillation means that the artificial/synthetic fibers 32 are of a flat, tape-like character and include longitudinally extending slits (not depicted) across a width thereof. With light brushing, these artificial/synthetic fibers 32 tend to split along the slits into several individual free-standing strands of a width that is thinner than the full width of the artificial/synthetic fibers 32 and thereby more closely resembles blades of grass.

An infill layer 36 of particulate material may be interspersed between the artificial/synthetic fibers 32 on the backing layer 34. In this arrangement, the artificial/synthetic fibers 32 are designed to extend a distance above the infill layer 36 of particulate material. The infill layer 36 may comprise sand, rubber, a mixture of sand and rubber crumb, or granulated particles of thermoplastic elastomers, rubbers, EPDM rubber, or cork. The infill layer 36 provides resiliency to the surface of the artificial turf system 10 and facilitates an upright position of the artificial/synthetic fibers 32. With continued reference to FIG. 2, in this embodiment, the artificial/synthetic fibers 32 may extend a length of about one (1) inch or greater from the upper surface of backing layer 34. The height of infill layer 36 extends from about ½ to ¾ of the height of the artificial/synthetic fibers 32, which means that the artificial/synthetic fibers 32 extend a distance of about ½ to ⅓ of their height above the top surface of the infill layer 36. Other ratios may be used as alternatives.

The artificial/synthetic fibers 32 and the backing layer 34 may be manufactured by tufting the artificial/synthetic fibers 32 through the backing layer 34. The backing layer 34 may comprise a single layer of material or multiple layers of material, and the individual layers may include a woven or nonwoven material.

The tufting may be performed utilizing a tufting machine (not depicted), which may be a power loom. Multiple ends of the artificial/synthetic fibers 32 may be fed to a bank of heavy needles with a typical span of twelve to fifteen feet. The tufting process involves the previously constructed primary backing layer 34 passing under the needles to anchor each stitch of the artificial/synthetic fibers 32. The artificial/synthetic fibers 32 are thereby stitched into the fabric of the backing layer 34, producing loops which form the turf pile. The artificial turf system 10 may include loop pile, cut pile, or a combination of cut and loop pile introduced simultaneously in the backing layer 34 by pushing off a certain number of loops from the hook before they are cut.

Once the artificial/synthetic fibers 32 are tufted in place through a primary backing layer 34*a*, the primary backing layer 34*a* may be coated on its underside with a urethane or latex coating, often referred to as a secondary backing 34*b*. The secondary backing 34*b* may help adhere the stitched artificial/synthetic fibers 32 to the primary backing layer 34*a* and provide dimensional stability to the artificial/synthetic fibers 32.

The resilient layer 26 is disposed on top of the second intermediate layer 24. In an embodiment where the resilient layer 26 comprises an elastomeric material, the resilient layer 26 may be applied to the second intermediate layer 24 via a paving process as will be evident to those of ordinary skill in the art based on this disclosure. Alternatively, in another embodiment, the resilient layer 26 may comprise closed cell foam. In this embodiment, the closed cell foam may be manufactured as a pad or mat that may be rolled for ease of transportation. The closed cell foam pad may be unrolled onto the intermediate layer 24 during installation. In a similar manner, the top layer 30 may be unrolled onto the resilient layer 26.

Referring now to FIGS. 3-6, the artificial turf system 10 includes a plurality of impact sensors 38. The impact sensors 38 may be utilized to measure one or more forces applied to the artificial turf system 10 during an event, such as, but not limited to, a game, a match, or athletic training. By measuring the forces applied to the top surface 28 of the artificial turf system 10 during an athletic event such as an American football game, the forces experienced by athletes may be directly and indirectly measured. Analyzing the data concerning the forces experienced by athletes may improve the efficacy of rule changes and equipment enhancement to prevent or mitigate athlete injuries. The plurality of impact sensors 38 may comprise one or more accelerometers, capacitive accelerometers, piezoelectric sensors, piezoresistive sensors, strain gage sensors, or any combination thereof.

For example, a piezoelectric sensor measures an electrical charge caused by mechanical stress to generate a signal corresponding to an impact. The piezoelectric sensor comprises a sensing material, such as quartz crystal. The voltage signal generated in the sensing material is proportional to the thickness of the sensing material in the direction of measurement. Piezoelectric sensors may be designed to detect forces applied in a transverse direction and in a longitudinal direction, as well as to detect shear forces. The artificial turf system 10 may comprise impact sensors 38 for detecting transverse forces, longitudinal forces, and shear forces.

Figures 6, 6A:
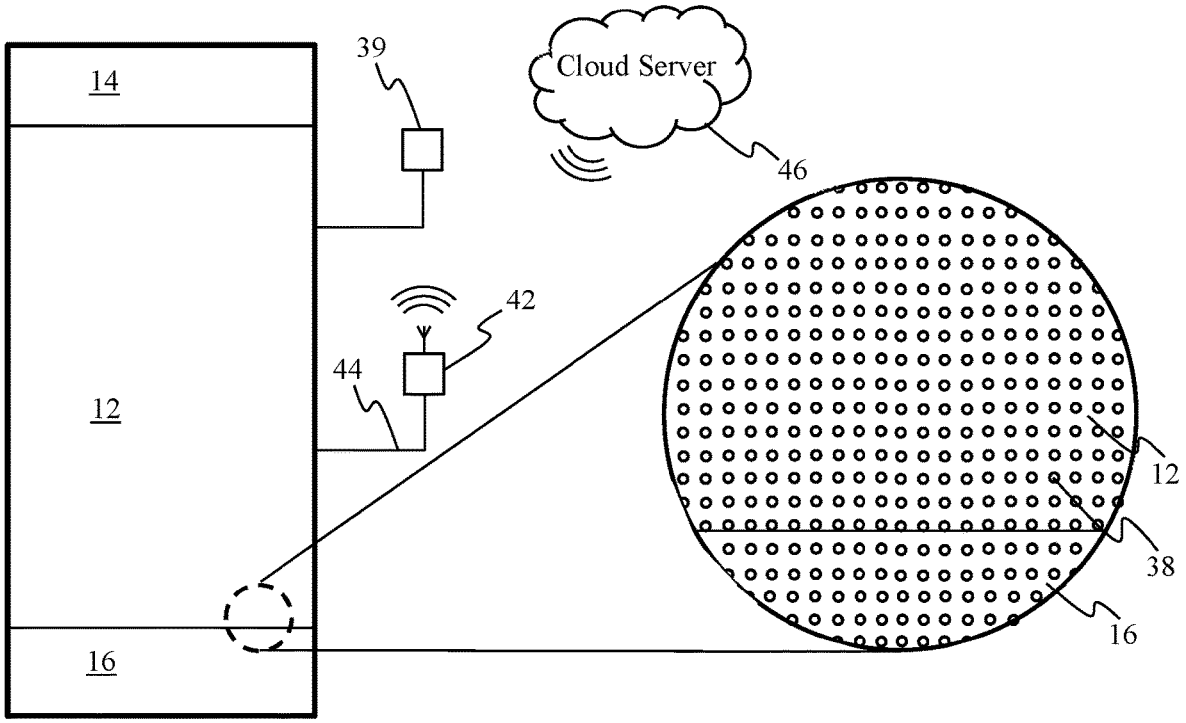
FIG. 6 is a schematic diagram of the artificial turf system according to an embodiment of the presently disclosed subject matter.
FIG. 6A is a detailed view of a portion of the artificial turf system according to FIG. 6.

As illustrated in FIG. 6, in an embodiment, the artificial turf system 10 may comprise an array of the impact sensors 38. The array of impact sensors 38 may be disposed in a grid or grid-like pattern. However, persons having skill in the relevant arts will recognize that other geometric patterns of the impact sensors 38 are possible. The grid distribution of the impact sensors 38 may be tailored for suitability to the specific athletic event intended for the artificial turf system 10. Utilizing an array of the impact sensors 38 may provide analysts with data regarding the forces experienced by an athlete during an initial impact event, such as a tackle. Additionally, an array of the impact sensors 38 may provide analysts with data regarding the forces experienced by an athlete in any subsequent impact events following the initial impact event; for example, a subsequent impact event may be the impact of an athlete's head/helmet upon the artificial turf system 10 after a portion of the athlete's legs, arms, or torso makes impact with the artificial turf system 10.

The impact sensors 38 may be in continual electrical communication with a power source 39 and a controller 42. As a non-limiting example, the power source 39 may be the electric power grid, a generator, and/or a solar panel array. The controller 42 may be in electrical communication with the impact sensors 38 via a wired or wireless connection and receive signals therefrom. As a non-limiting example, the wireless connection may be a Wi-Fi connection, a Bluetooth connection, and/or an electromagnetic wave connection. In an embodiment, as illustrated in FIG. 6, the impact sensors 38 may be electrically connected with the controller 42 via a wired connection 44. Additionally, the controller 42 may be in electrical communication with one or more servers 46. For example, without limitation, the controller 42 may continuously, or at pre-determined intervals, transmit signals to a cloud-based server 46.

Figure 3:
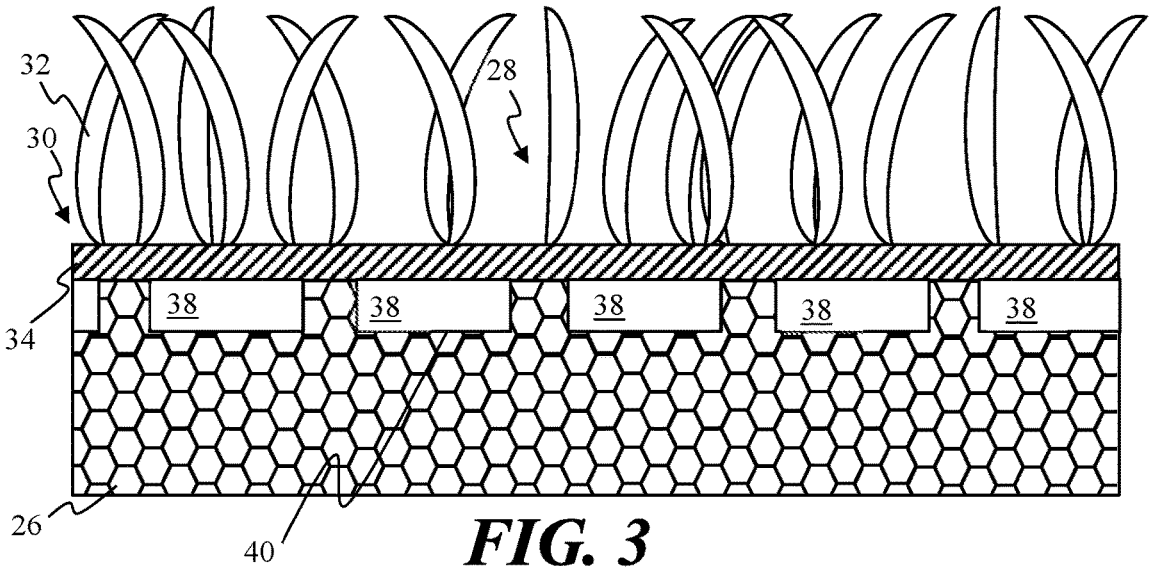
FIG. 3 is a cross-sectional view of a portion of the artificial turf system according to an embodiment of the presently disclosed subject matter.
Figure 7:
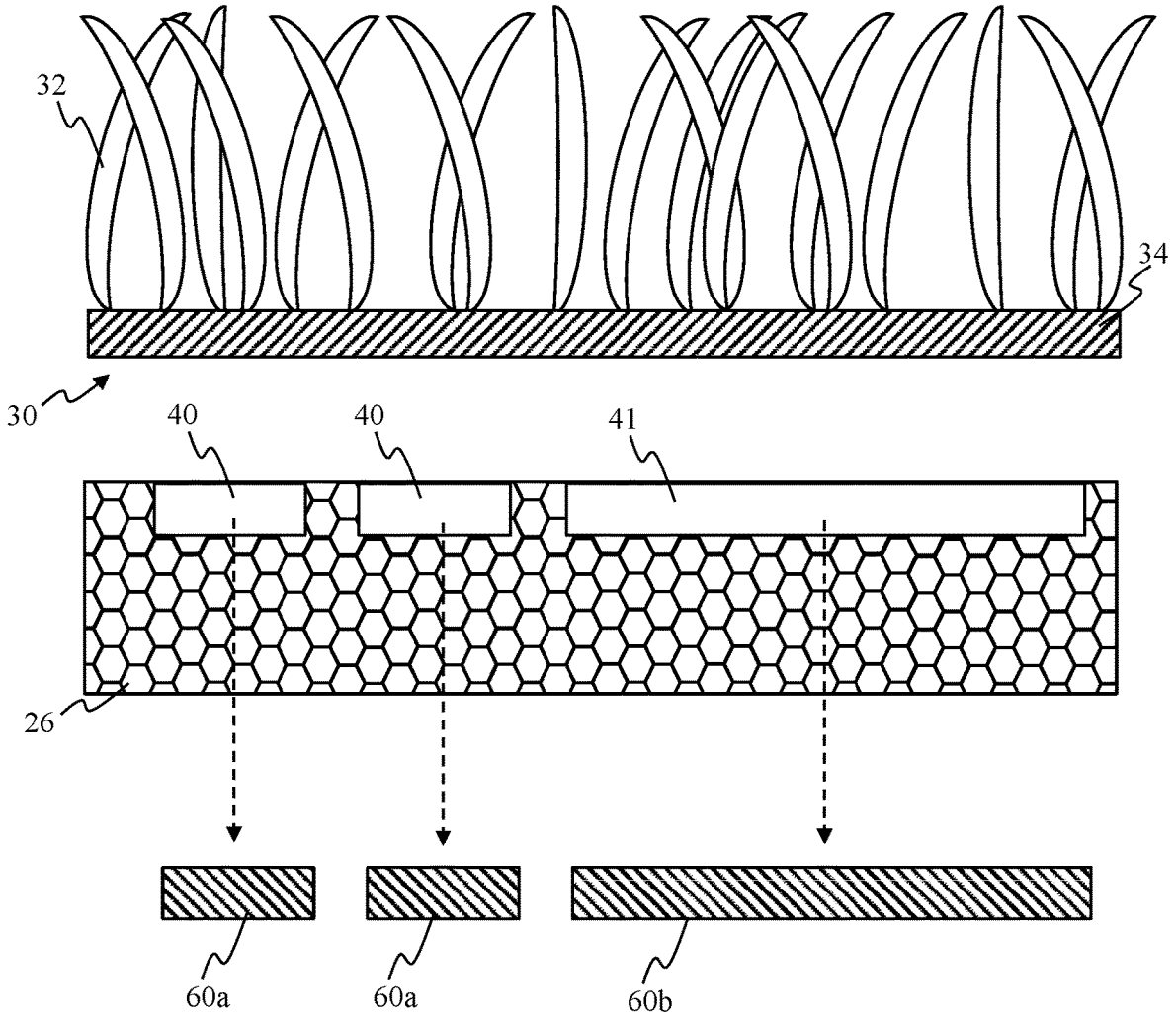
FIG. 7 is a partially exploded cross-sectional view of the artificial turf system according to FIG. 3A.
Figure 8:
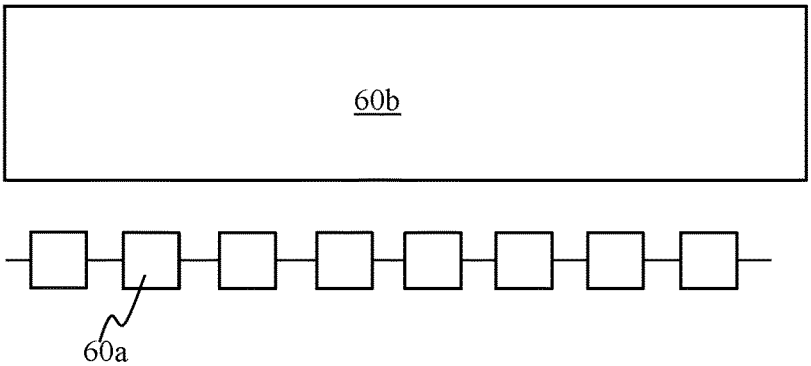
FIG. 8 is a schematic diagram of the channel forms according to an embodiment of the presently disclosed subject matter.

As illustrated in FIGS. 3 and 7, in an embodiment, the elastomeric layer 26 may be formed using a paving process, and channel forms 60*a*, 60*b* may be positioned where sensor recesses 40 and power cable channels and/or communication line/conduit recesses 41 are desired. The channel forms 60*a*, 60*b* may be constructed of a sturdy lightweight material such as aluminum. The channel forms 60*a*, 60*b* fill a space to prevent elastomeric material from entering the space during paving. After the elastomeric layer 26 dries and sets, the channel forms 60*a*, 60*b* are removed. In another embodiment, the elastomeric layer 26 may be applied as a continuous flat surface, and cable channels 41 and sensor recesses 40 may thereafter be cut or ground into the elastomeric layer 26. The impact sensors 38 are then at least partially disposed in the sensor recesses 40 before the top layer 30 is installed. Thus, the impact sensors 38 are provided to sense the impact on the top of the elastomeric layer 26 and/or the backing layer 34. In an embodiment, the sensor recess channel forms 60*a* are connected via a tether.

Figure 3A:
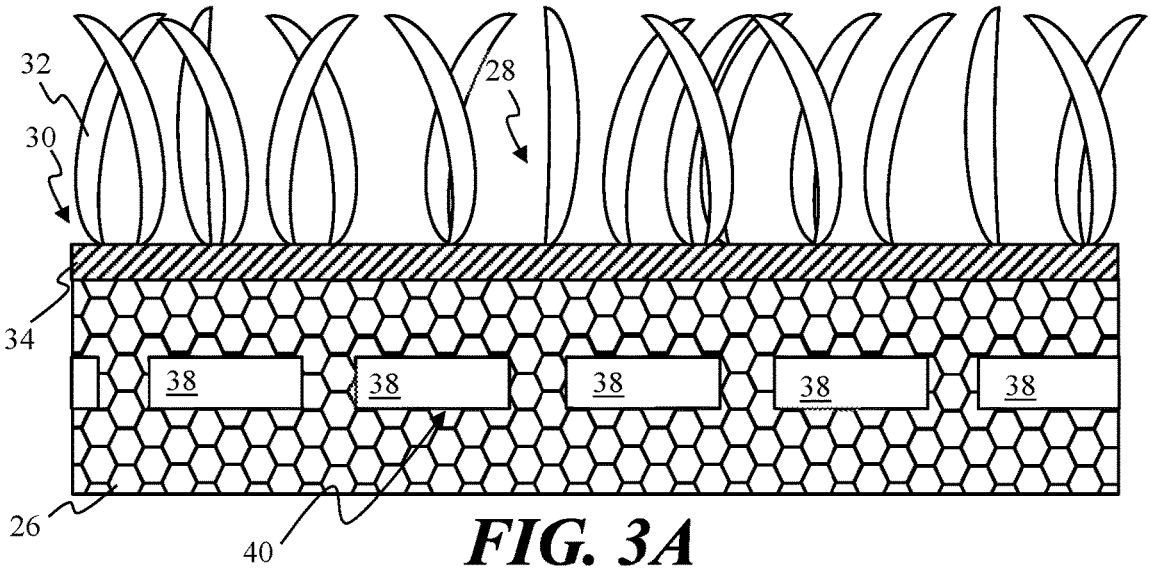
FIG. 3A is a cross-sectional view of a portion of the artificial turf system according to another embodiment of the presently disclosed subject matter.

As illustrated in FIG. 3A, in an embodiment, the impact sensors 38 may be incorporated, integrated, or embedded into the elastomeric layer 26 during the paving process. In this embodiment, the impact sensors 38 are disposed in the elastomeric layer 26 such that when the elastomeric material sets, the elastomeric material entirely surrounds the impact sensors 38.

Figure 4:
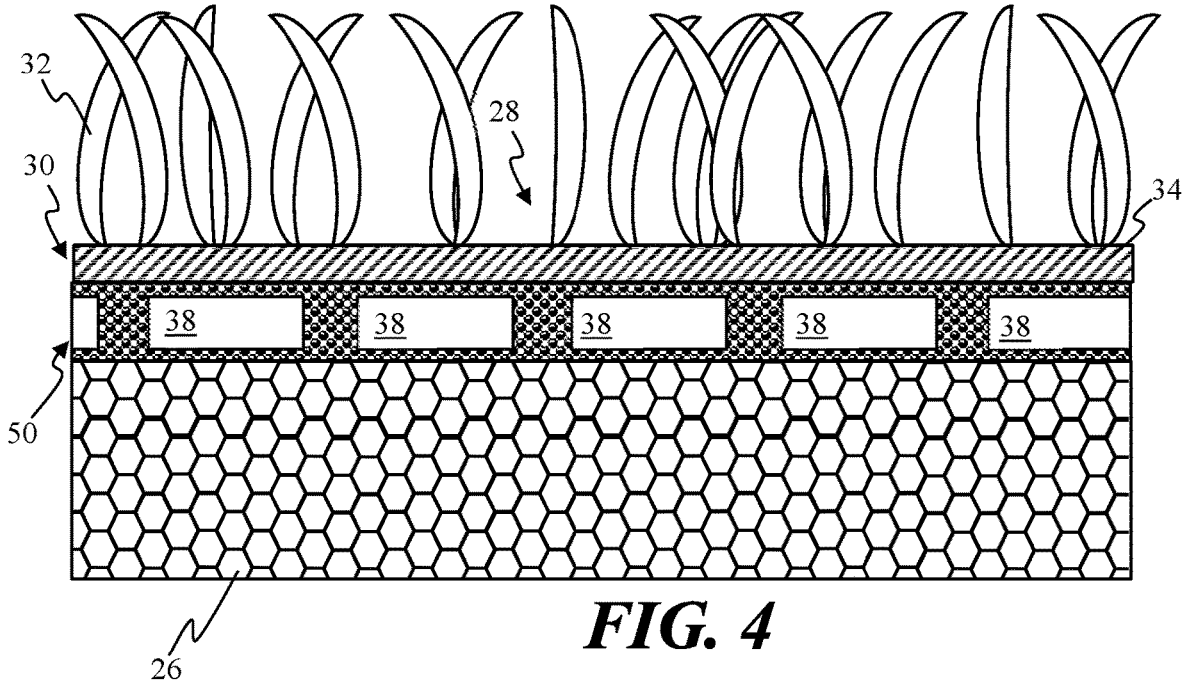
FIG. 4 is a cross-sectional view of a portion of the artificial turf system according to yet another embodiment of the presently disclosed subject matter.

As illustrated in FIG. 4, in another embodiment, the impact sensors 38 may be integrated, embedded, or incorporated within a specially formed sensor layer 50. For example, without limitation, the sensor layer 50 comprise a polymeric foam or other encapsulating material. The sensor layer 50 may be disposed on the resilient layer 26 before the top layer 30 is installed. In an embodiment, the sensor layer 50 may be formed off site with the impact sensor array 38 fully integrated therein.

Figure 5:
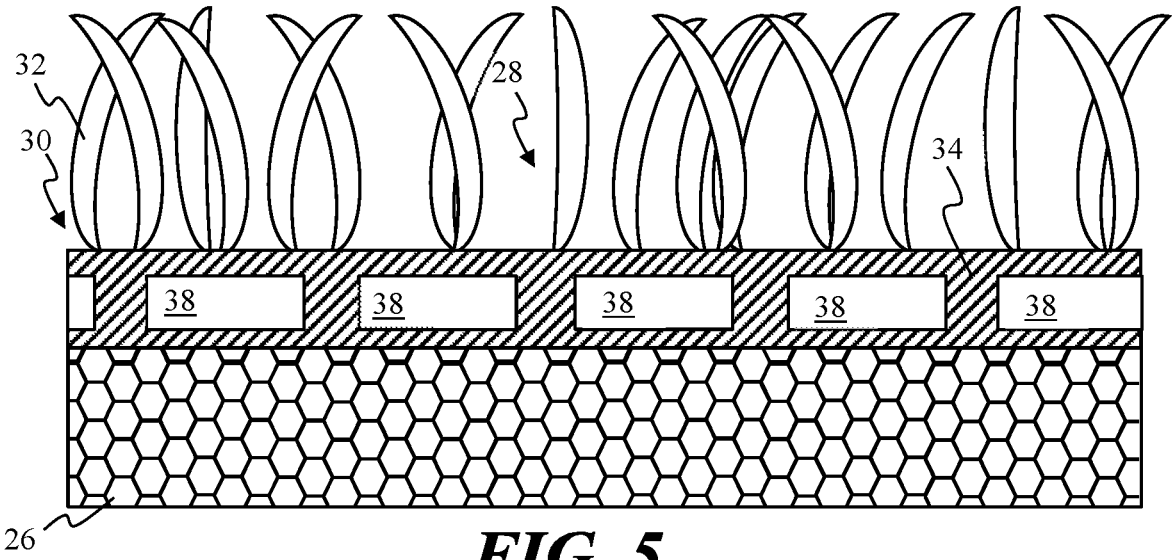
FIG. 5 is a cross-sectional view of a portion of the artificial turf system according to still another embodiment of the presently disclosed subject matter.

As illustrated in FIG. 5, in yet another embodiment, the impact sensors 38 are disposed in the backing layer 34. In this embodiment, the impact sensors 38 may be disposed in either the primary or secondary backing layer 34*a*, 34*b*. For example, the primary backing layer 34*a* may be disposed in an inverted position, the impact sensors 38 may be located in a predetermined position on the backing layer 34*a*, and then the secondary backing layer 34*b* may be applied to the primary backing layer 34*a* and to the impact sensors 38. In this manner, the impact sensors 38 may be coupled with the backing layer 34.

Figure 5A:
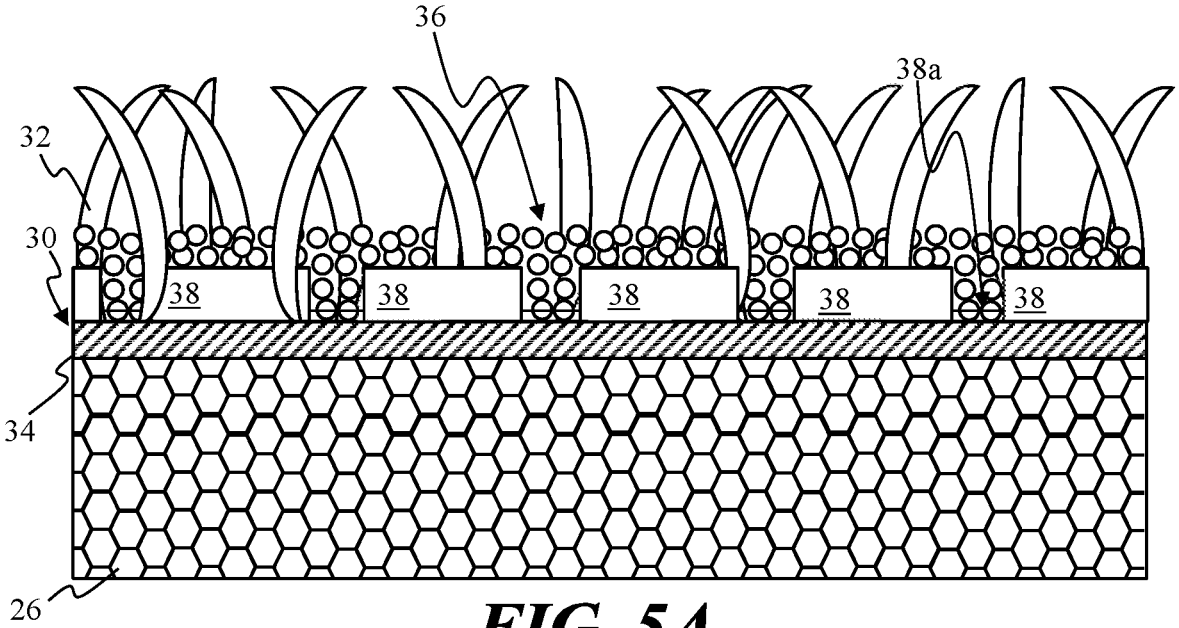
FIG. 5A is a cross-sectional view of a portion of an artificial turf system according to an embodiment of the presently disclosed subject matter.

As illustrated in FIG. 5A, in an embodiment, the impact sensors 38 are disposed at least partially in the infill layer 36. The impact sensors 38 may be connected via a backing 38*a* to facilitate maintenance of the relative position of the impact sensors 38 during an athletic event. In an embodiment, the backing 38*a* comprises a mesh.

Figure 9:
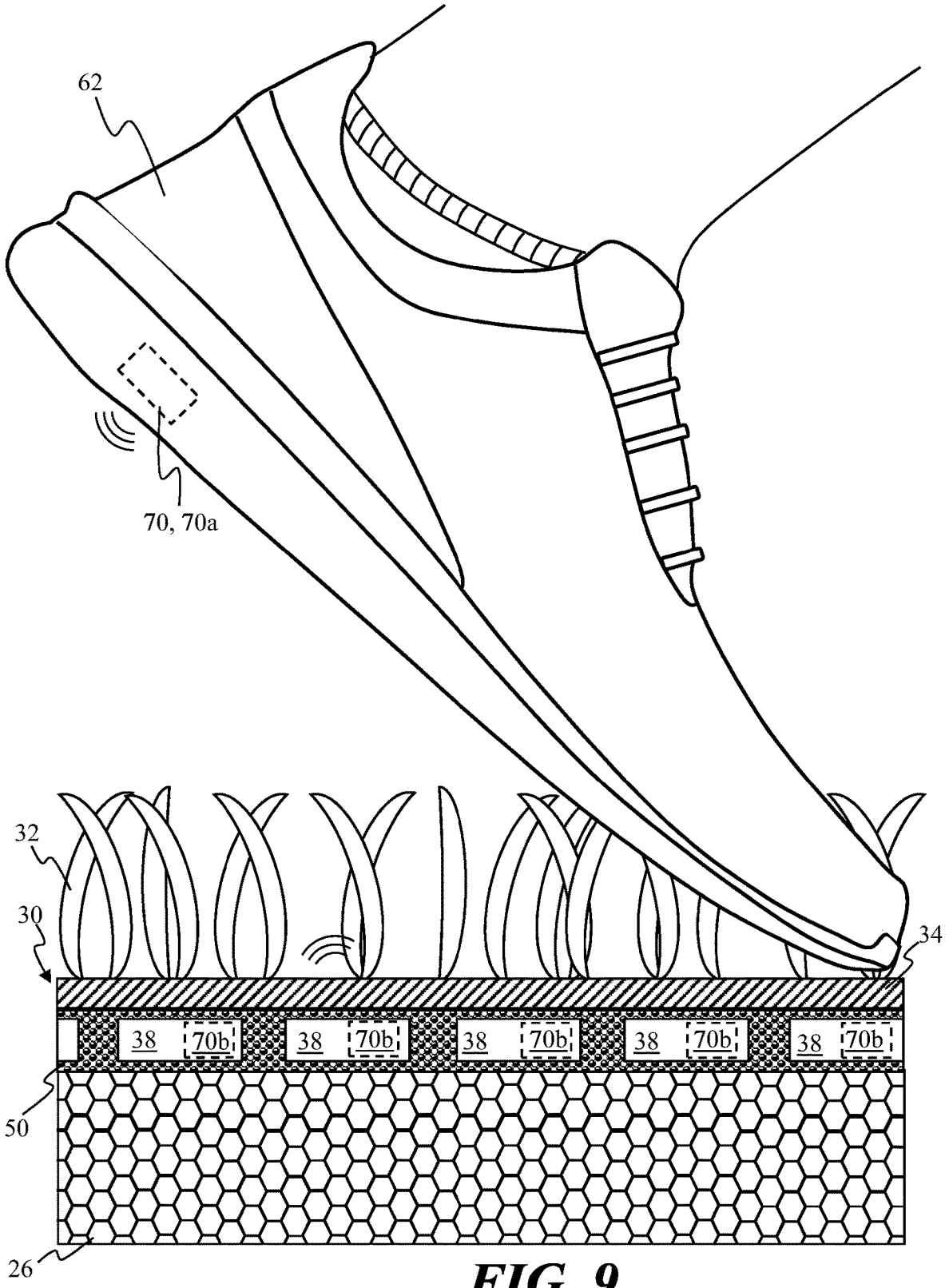
FIG. 9 is a cross-sectional view of a portion of an artificial turf system according to an embodiment of the presently disclosed subject matter.

In an embodiment, as illustrated in FIG. 9, the artificial turf system 10 includes one or more athlete sensors 70 coupled to one or more athletes to distinguish the forces applied to the top surface 28 of the artificial turf system 10 during an athletic event. For example, the athlete sensors 70 may be located in one or more articles of footwear 62 (e.g., athletic shoes or cleats). In another example, the one or more athlete sensors 70 are located in an athlete's helmet. In an embodiment, the athlete sensors 70 are position sensors associated with individual athletes. For example, the athlete sensors 70 may comprise Global Positioning System (GPS) receivers operable to determine the position of an athlete at discrete intervals of time. To increase the usefulness and accuracy of the GPS positioning of the athlete sensors 70, each impact sensor 38 may have its coordinates mapped, and individual identifier associated therewith, prior to an athletic event. The impact sensor 38 mapping data may be stored in the controller 42, which includes a non-transitory computer readable medium. The non-transitory computer readable medium of the controller 42 includes program instructions stored thereon operable to directly or indirectly transmit and/or display data associated with an impact event, including but not limited to, time, location, participant(s), and force measured.

In another embodiment, the athlete sensors 70 comprise Radio-Frequency Identification (RFID) tags 70*a*. To identify the RFID tags 70*a*, the impact sensors 38 include, or have their position associated with, an RFID reader 70*b* operable to receive signals from the athlete sensor RFID tags 70*a*. For example, the athlete sensors 70 may comprise an Active Reader Passive Tag system (ARPT).

In an embodiment, the athlete sensors 70 enable the athletes to be monitored while on the artificial turf system 10 to provide data for athlete safety analytics. For example, the conditions leading-up to and during an impact event may be quantified utilizing the athlete sensors 70 and impact sensors 38, including but not limited to, speed, direction, force, and impact dispersion area.

One or more features of the embodiments described herein may be combined to create additional embodiments which are not depicted. While various embodiments have been described in detail above, it should be understood that they have been presented by way of example, and not limitation. It will be apparent to persons skilled in the relevant arts that the disclosed subject matter may be embodied in other specific forms, variations, and modifications without departing from the scope, spirit, or essential characteristics thereof. The embodiments described above are therefore to be considered in all respects as illustrative, and not restrictive. The scope of the invention is indicated by the appended claims, and all changes that come within the meaning and range of equivalents thereof are intended to be embraced therein.

What is claimed is:

1. An artificial turf system, comprising:

a backing layer having a plurality of fibers extending therefrom;

a plurality of impact sensors located at least partially beneath said backing layer, wherein said plurality of impact sensors are operable to detect a force or pressure applied to said backing layer by one or more athletes at a discrete interval of time;

at least one position sensor coupled with each of said one or more athletes, wherein each of said at least one position sensors is operable to determine a position of said one or more athletes at said discrete interval of time relative to one or more of said plurality of impact sensors and relative to a position of another of said one or more athletes; and a controller arranged to receive signals from said plurality of impact sensors, wherein said controller is configured to at least temporarily store a speed and said position of at least two of said one or more athletes at said discrete interval of time, wherein said discrete interval of time includes a direct or indirect impact of one or more athletes with said backing layer.

2. The artificial turf system according to claim 1, wherein said position sensors comprise Global Positioning System (GPS) receivers.

3. The artificial turf system according to claim 1, wherein said position sensors comprise Radio-Frequency Identification (RFID) tags, and said impact sensors comprise an RFID reader operable to receive signals from said RFID tags.

4. The artificial turf system according to claim 1, wherein said controller is operable to determine a dispersion area of said direct or indirect impact utilizing said speed and said position of said one or more athletes at said discrete interval of time and said force or pressure detected by said plurality of impact sensors.

* * * * *